United States Patent [19]

Ahroni

[11] 4,388,604

[45] Jun. 14, 1983

[54] FUSED PLUG ASSEMBLY WITH PUSH-IN FUSE UNIT

[76] Inventor: Joseph M. Ahroni, P.O. Box 3907, Seattle, Wash. 98124

[21] Appl. No.: 259,516

[22] Filed: May 1, 1981

Related U.S. Application Data

[63] Continuation of Ser. No. 101,497, Dec. 10, 1979.

[51] Int. Cl.[3] ..... H01H 85/02

[52] U.S. Cl. ..... 337/197; 337/283; 337/293

[58] Field of Search ..... 337/197, 198, 283, 284, 337/290, 293, 295

[56] References Cited

U.S. PATENT DOCUMENTS

| | | | |
|---|---|---|---|
| 2,225,718 | 12/1940 | Sheppley et al. | 337/198 |
| 2,462,934 | 3/1949 | Athey | 337/198 |
| 4,196,409 | 4/1980 | Juba | 337/198 |

*Primary Examiner*—George Harris

*Attorney, Agent, or Firm*—Seed, Berry, Vernon & Baynham

[57] ABSTRACT

A fused electrical plug assembly is provided having a plug body with a fuse socket open to one side to hold a push-in fuse unit. The fuse unit has one pair of active fuse elements between which there is a spare pair which can be used by removing the fuse unit, turning it ninety degrees and pushing it back into the fuse socket.

5 Claims, 3 Drawing Figures

FUSED PLUG ASSEMBLY WITH PUSH-IN FUSE UNIT

This is a continuation of application Ser. No. 101,497, filed Dec. 10, 1979.

BACKGROUND OF THE INVENTION

1. Field of the Invention

The present invention relates to fused electrical plugs with replaceable fuses, and particularly to those for use with Christmas tree light sets and other decorative light sets.

2. Description of the Prior Art

Electrical add-on plugs having replaceable internal fuses for opening an electrical circuit responsive to excess current flow are in use on decorative light sets. Typical designs are shown in U.S. Pat. Nos. 3,976,967; 4,080,039 and 4,178,061.

Need has arisen for a safe, reliable, cheaper and simpler plug unit having a minimum of parts and in which a fuse is easy to change. There is also a need for a plug unit having a simpler means of providing a spare fuse. The present invention aims to meet these needs.

SUMMARY OF THE INVENTION

In accordance with the present invention the use of fuse carriers and fuse access covers at the sides of electrical plugs has been eliminated by providing a push-in fuse unit located in the plug body within the zone between the longitudinal axes of the prongs (blades). The fuse unit is preferably square in cross-section and has an active pair and a spare pair of fuse elements along its four sides, the active pair engaging two sets of contacts provided by the prong members and by the wire leads at opposite sides of a socket receiving the fuse unit. The spares can be put into use by removing the fuse unit from the socket and reinserting it after turning it ninety degrees.

DETAILED DESCRIPTION OF THE INVENTION

Figure 1:
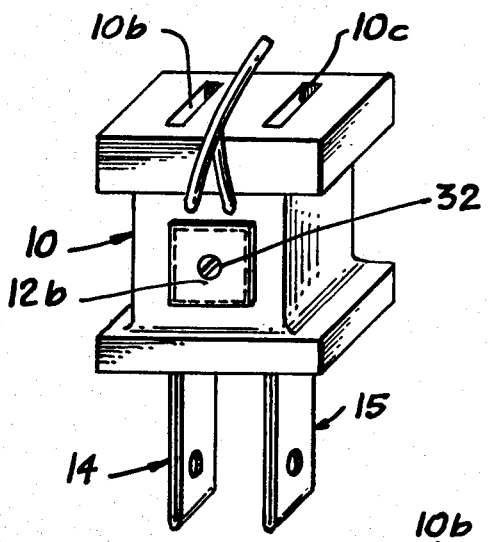
FIG. 1 is a perspective view of a fused plug assembly embodying the present invention.
Figure 2:
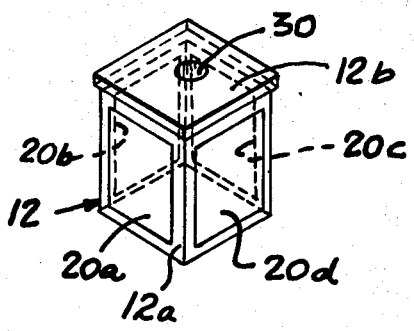
FIG. 2 is an enlarged, elevational view of the plug assembly shown partly in vertical section.
Figure 3:
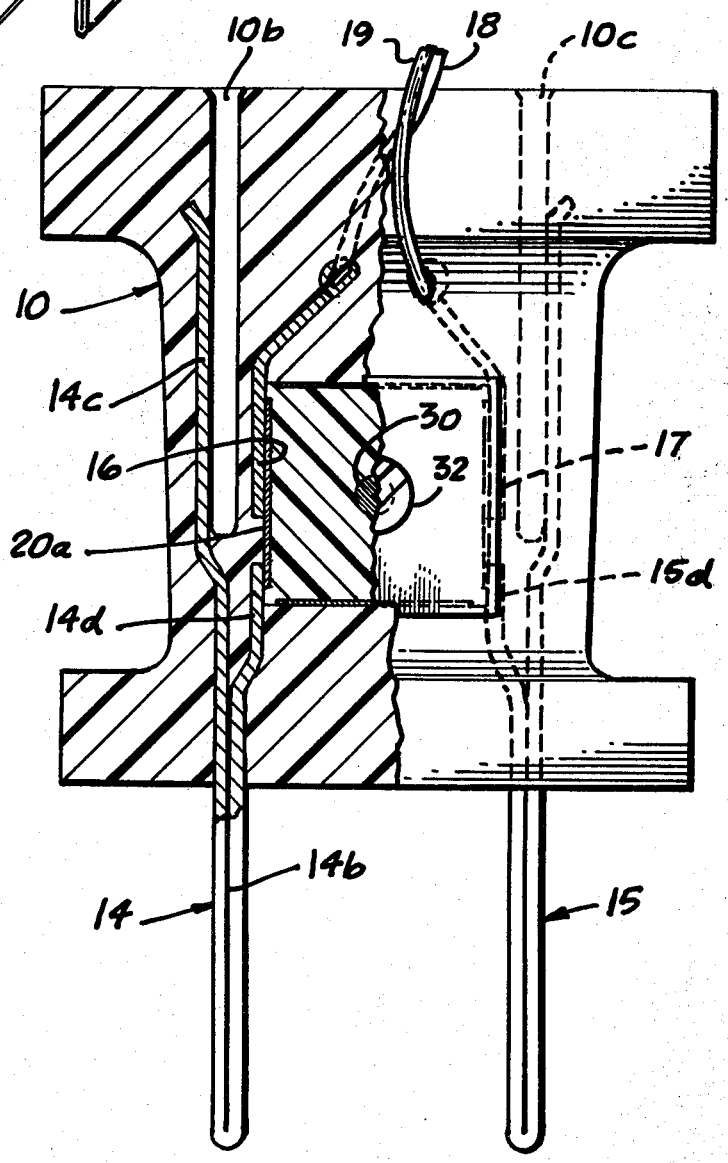
FIG. 3 is an enlarged view of the fuse unit to a smaller scale than in FIG. 2.

Referring to the drawings it is seen that the fused plug assembly of the present invention comprises a plug body 10, a push-in fuse unit 12, a pair of prong members 14–15, and a pair of wire contacts 16–17 connected to a pair of leads 18–19. The plug body 10 is formed with a central square fuse receiving socket **10*a* at the front side with an enlarged upper rim portion and has a pair of standard prong sockets 10*b*, 10*c*** at the outer end.

The fuse unit 12 has a generally square body in transverse cross-section and is formed with an enlarged head **12*b*. Two pairs of fuse element strips 20*a–d* extend along the four outer faces of the fuse body 12*a*, one opposite pair 20*a*, 20*c* of these strips electrically interconnecting the prong members 14—15 with the wire contacts 16–17 while the other pair 20*b*, 20*d*** remain as spares.

The prong members 14–15 are alike, but positioned with opposite orientation; hence, only prong member 14 will be described in detail. It is formed by doubling back the brass prong stock from the projecting tip to form an exposed prong **14*b* of double thickness for insertion into a wall socket or other plug. Within the plug body the prong member has two separated legs, one leg 14*c* being outwardly offset to extend along the outer side of the prong socket 10*b* to engage the respective prong 22 of an add-on plug when plugged into the plug body 10. The other leg is bent inwardly and then rearwardly to provide a contact portion 14*d* exposed to the fuse socket 10*a*. This contact portion 14*d* is opposed by a contact portion 15*d* on the opposite side of the fuse socket. The contacts 16–17 are aligned with and spaced toward the outer end of the plug body from the contact portions 14*d*, 15*d* so that the fuse elements 20*a*, 20*c* will engage and electrically interconnect the contacts 16–17 with the contact portions 14*d*, 15*d* of the prong members. The insulated leads 18–19 have bare wire terminal portions connected to the contacts 16–17 as by crimping extensions of the contacts therearound and extend from their connections out through the back of the plug body. The fuse elements 20*a–d*** are formed from a suitable conductive foil such as, for example, zinc foil and are secured by a suitable adhesive to the fuse body. The exact thickness and width of the fuse elements, of course, depend upon the desired fuse rating. For a 3 ampere fuse, zinc foil strips 0.001 inch thick and 0.062 inch wide can be used.

It will be appreciated that the plug body 10 can be injection molded in one piece with the prong members 14–15 and contacts 16–17 and connected wires 18–19 in place in the mold. The body of the fuse 12 can also be injection molded as one piece whereupon the fuse elements **20*a–d*** are attached as by a suitable pressure sensitive adhesive. Hence the plug assembly need only have two plastic parts.

To lock the fuse unit in place in the plug body the fuse body may be provided with a center through bore 30 which is aligned with a hole in the plug body exposed at the base of the socket **10*a*. A self-tapping screw 32 passes through the bore 30 and is screwed into the hole in the plug body. If one of the fuse elements 20*a*, 20*c* should sever because of an overload or short circuit, after the difficulty is corrected, the spare elements 20*b*, 20*c*** can be placed in operation merely by removal of the fuse unit, turning it ninety degrees, and pushing it back into the fuse socket as before.

I claim:

1. A fused plug assembly comprising:

a plug body formed with a central fuse socket;

a pair of coplanar, spaced prong members projecting as prongs from one end of the plug body, said prong members each being exposed by a contact portion to the fuse socket;

a pair of wire leads extending from the plug body and having a pair of spaced wire contacts exposed to said fuse socket in general alignment with and spaced from respective of said contact portions;

a push-in fuse means having a fuse body slidably received in the fuse socket in a direction perpendicular to the plane of the prong members and having a central hole therethrough extending in said direction, said fuse means having an active pair of spaced fuse elements mounted directly on said fuse body and each arranged to engage a said contact portion and respective wire contact, said fuse body also having a spare pair of fuse elements mounted directly thereon and arranged to become active responsive to removal of the fuse means from the fuse socket, changing the orientation of the fuse means relative to the socket to a reoriented position in which said central hole also extends in said direction and said spare fuse elements occupy the position previously occupied by said active fuse elements, and then reinserting the reoriented fuse unit; and a removable threaded locking device passing through said central hole into said plug body for holding the fuse means in said socket.

2. A fused plug assembly according to claim 1, in which said fuse body is generally square in cross-section and has said central hole passing through the center of said square, said active fuse elements being on one pair of opposite sides of said square and the spare fuse elements being on the other pair of opposite sides of said square.

3. A fused plug assembly according to claim 2, in which said fuse means has a cover seating against the plug body at the rim of said socket, said fastening device also passing through said cover and having a head bearing against the cover.

4. A fused plug assembly according to claim 1 in which each of said fuse elements comprises a strip of conductive foil bonded to the fuse body.

5. A fused plug assembly comprising:

a plug body formed with a fuse socket having an open mouth, said fuse socket having two pairs of opposite sides, two respective spaced electrical contacts on each side of one of two pairs;

a push-in fuse unit having a fuse body slidably mounted in said fuse socket and generally conforming to the shape thereof, said unit having respective fuse elements mounted directly thereon along each of its sides arranged to provide two fuse elements engaging the contacts at opposing sides of the fuse socket and to provide two spare fuse elements therebetween; and a pair of coplanar prongs projecting from the plug body at one end thereof and connected to two of said contacts, the plane of said prongs being generally parallel with the mouth of the fuse socket.

* * * * *